United States Patent [19]

Takahashi

[11] Patent Number: 4,865,475

[45] Date of Patent: Sep. 12, 1989

[54] PRINTER ADJUSTING THE PRINT HAMMER POSITION FOR PRECISE PRINTING

[75] Inventor: Kiyoshi Takahashi, Nagoya, Japan

[73] Assignee: Brother Kogyo Kabushiki Kaisha, Japan

[21] Appl. No.: 135,339

[22] Filed: Dec. 21, 1987

[30] Foreign Application Priority Data

Jan. 7, 1987 [JP] Japan ..... 62-1455

[51] Int. Cl.[4] ..... B41J 1/30

[52] U.S. Cl. ..... 400/144.2; 400/53; 400/157.1; 400/704

[58] Field of Search ..... 400/53, 144.2, 144.3, 400/157.1, 157.2, 163, 703, 704

[56] References Cited

U.S. PATENT DOCUMENTS 4,746,235 5/1988 Mueller et al. ..... 400/144.2

FOREIGN PATENT DOCUMENTS 189852 8/1986 European Pat. Off. ..... 400/703
200439 12/1986 European Pat. Off. ..... 400/144.2
3221561 12/1983 Fed. Rep. of Germany ... 400/144.2
172563 9/1985 Japan ..... 400/53
179768 8/1986 Japan ..... 400/163
205157 9/1986 Japan ..... 400/144.2

*Primary Examiner*—David A. Wiecking
*Attorney, Agent, or Firm*—Oliff & Berridge

[57] ABSTRACT

A printer, which can adjust the attached position of the print hammer without a device specifically provided for the position-adjustment, is provided with an adjustment mode in addition to a normal printing mode. In the adjustment mode, a predetermined type on the type wheel is set into a predetermined printing position by the rotation of the type wheel, in the same manner as in the normal printing mode. Accordingly the attached position of the print hammer is adjusted easily to establish accurate contact between the hammer and the type in the printing position.

5 Claims, 8 Drawing Sheets

PRINTER ADJUSTING THE PRINT HAMMER POSITION FOR PRECISE PRINTING

BACKGROUND OF THE INVENTION

The present invention relates to a printer which executes printing in such a manner that a type wheel rotates in order to set one of the types thereon into a printing position where the print hammer accordingly strikes it.

In the conventional printers of this kind, unless the type at the printing position is exactly opposite to the print hammer, the print hammer does not hit the type squarely and a corresponding character is not printed clearly. To solve this problem, one conventional printer has been provided with a print hammer where contact with each type in the printing position is adjustable. More particularly, before this printer is transported from the factory, the attached position of the print hammer is adjusted to establish the best contact of the print hammer with each type on the type wheel in the following manner: a specific device provided for the position-adjustment rotates the type wheel in simulation of the printing action so as to set one of the types into its printing position. Owing to this conventional position-adjusting device, the printer can print more clearly than those printers in which attachment of the print hammer is not adjustable.

As the printer is being used after transportion from the factory, the position of the print hammer will be occasionally displaced relative to the types due to a change in the motor's characteristic or a vibration by the motor. However, the user of this printer does not have such a position adjusting device that is usually used in the factory for adjusting the position of the print hammer before transportation. Thus, the user has to send the printer out for repair so as to adjust the print hammer to an appropriate position.

More specifically, a type is set into the printing position for printing, and its actual stop position slightly differs from that of the others depending on: the weight of a spoke of each type of the type wheel; the accuracy of the motor for rotating the type wheel; and the rotational direction of the type wheel. Therefore, it is necessary to adjust the attached position of the print hammer for the best contact with each type by means of the specific position-adjusting device. Even if the user wants to adjust the position of the print hammer relative to the types without this position-adjusting device, he or she can adjust it only relative to a predetermined type which is set in the printing position whenever the printer stops.

SUMMARY OF THE INVENTION

It is accordingly an object of the present invention to provide a printer which can adjust the attached position of the print hammer without a specific adjusting device.

As shown FIG. 1, this object is attained by a printing control device comprising: a print mechanism M4 such as a carriage including a type wheel 5 provided with a plurality of types, a wheel motor 15 for rotating the type wheel 5, and a print hammer 9 secured adjustably to a predetermined position opposite the type wheel; first type position control means M5 for driving the wheel motor 15 so as to rotate the type wheel 5 and to set a type on the type wheel 5 into a printing position in response to print information in a printing mode; print hammer control means M6 for striking the type with the print hammer 9 so as to print a character on a sheet corresponding to the print information; mode setting means M7 for stopping the first type position control means M5 and the print hammer control means M6 and for setting an adjustment mode in which a print hammer position relative to the type on the type wheel is adjusted; operation means M8 for designating a predetermined type on the type wheel 5; and second type position control means M9 responsive to the operation means M8 for driving the wheel motor 15 so as to rotate the type wheel 5 and to set the predetermined type into the printing position during the adjustment mode.

BRIEF DESCRIPTION OF THE DRAWINGS

The invention will now be described with reference to the accompanying drawings wherein.

DETAILED DESCRIPTION OF THE PREFERRED EMBODIMENT

Hereinafter, a printer embodying the present invention will be described in detail with reference to the drawings.

Figure 2:
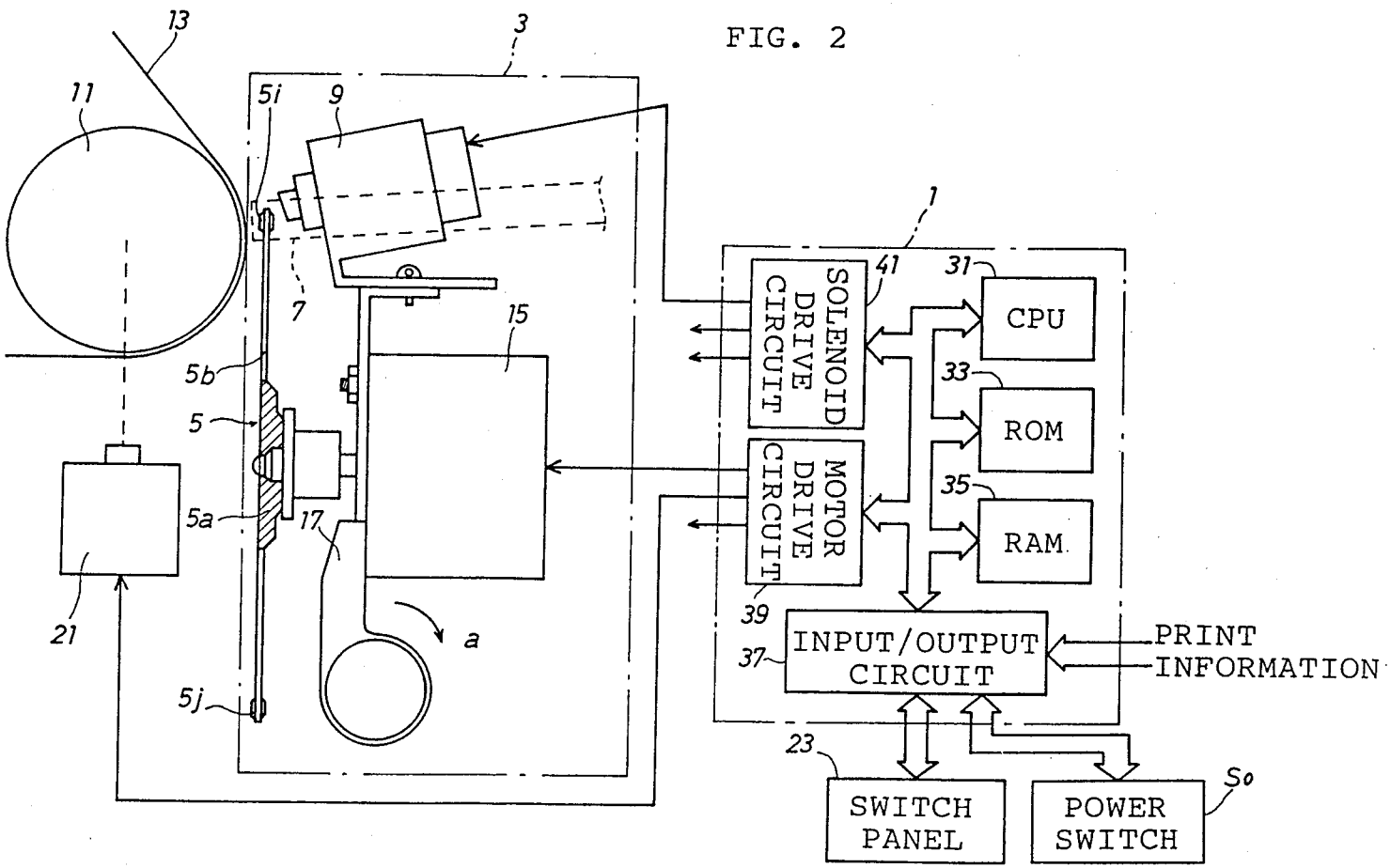
FIG. 2 is another schematic diagram illustrating the structure thereof.

FIG. 2 illustrates a schematic structure of a print mechanism connected with an electronic control unit 1 of the printer. The printer in this embodiment executes printing under control of the electronic control unit 1 in the following manner. According to the inputted print information, a type wheel 5 on a carriage 3 is rotated so as to place a type **5*i* in a printing position where an ink ribbon 7 is provided. Thereafter, a print hammer 9 strikes the type 5*i*, and thus a character is printed on a sheet of paper 13 fixed on a platen 11**.

Figure 3:
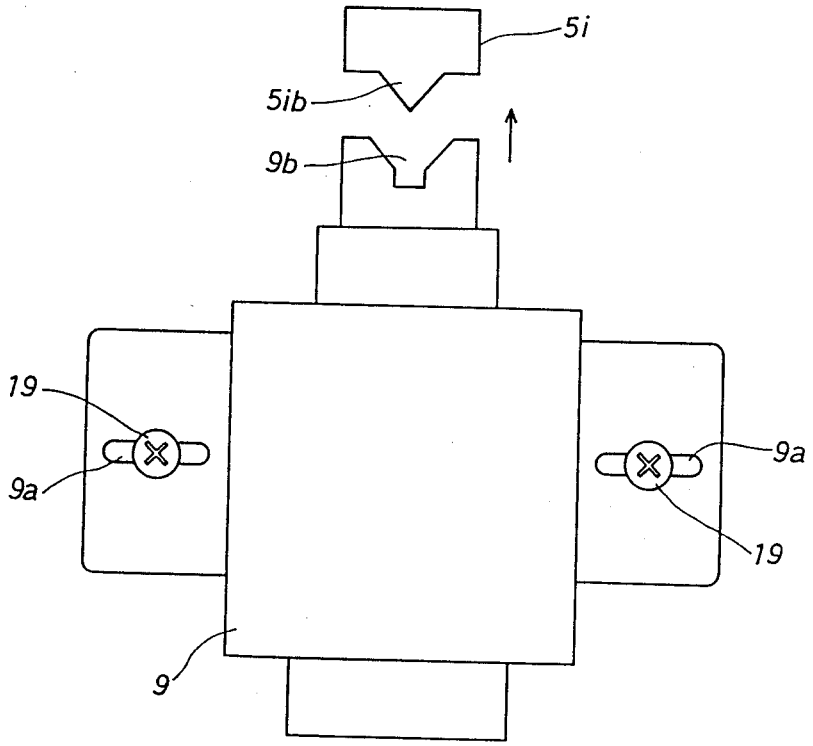
FIG. 3 is a plan view for showing an attached portion and an opposite-to-type portion of the print hammer.

The carriage 3 comprises the type wheel 5, the print hammer 9, and also a wheel motor 15 in the form of a stepping motor which can rotate the type wheel 5 at high speed. The type wheel 5 is removably attached to a rotation shaft of the wheel motor 15. The wheel motor 15 is mounted on a motor support 17 which can be rotated in a direction shown by an arrow "a" in FIG. 2 when the type wheel 5 is attached or removed. The print hammer 9 is fixed on the upper portion of the motor support 17 where the print hammer 9 strikes the type **5*i* in the printing position. A portion of the print hammer 9, attached to the motor support 17 thereby, has a slot 9*a* as shown in FIG. 3. A screw 19 fastens the print hammer 9 through the slot 9*a* so that the print hammer 9 can be attached corresponding to the type 5*i* by sliding right and left in the drawing. The print hammer 9 has a depression 9*b* opposite to the type 5*i*, and the type 5*i* has a protrusion 5*b* opposite to the print hammer 9. Thus, the depression 9*b* fixes the protrusion 5*b* so as to secure the type 5*i* when the print hammer 9 strikes the type 5*i***.

The type wheel 5 consists of a number of spokes **5*b***, each spoke being provided with a type at one end and arranged radially around a mount member 5*a* by which the type wheel 5 is fixed to the wheel motor 15. FIG. 2 illustrates a longitudinal section of the type wheel 5 cutaway at the center thereof, including two types—the type 5*i* which is set in the printing position provided with the ink ribbon 7, and another type 5*j* located just under the type 5*i*; illustration of the other types on the type wheel 5 is omitted.

The print hammer 9 and the wheel motor 15 are controlled by the electronic control unit 1, which also controls a paper feed motor 21 and a carriage motor (not shown). The paper feed motor 21 advances a sheet of paper 13 by rotating the platen 11. The carriage motor moves the carriage along the axis of the platen 11.

Figure 1:
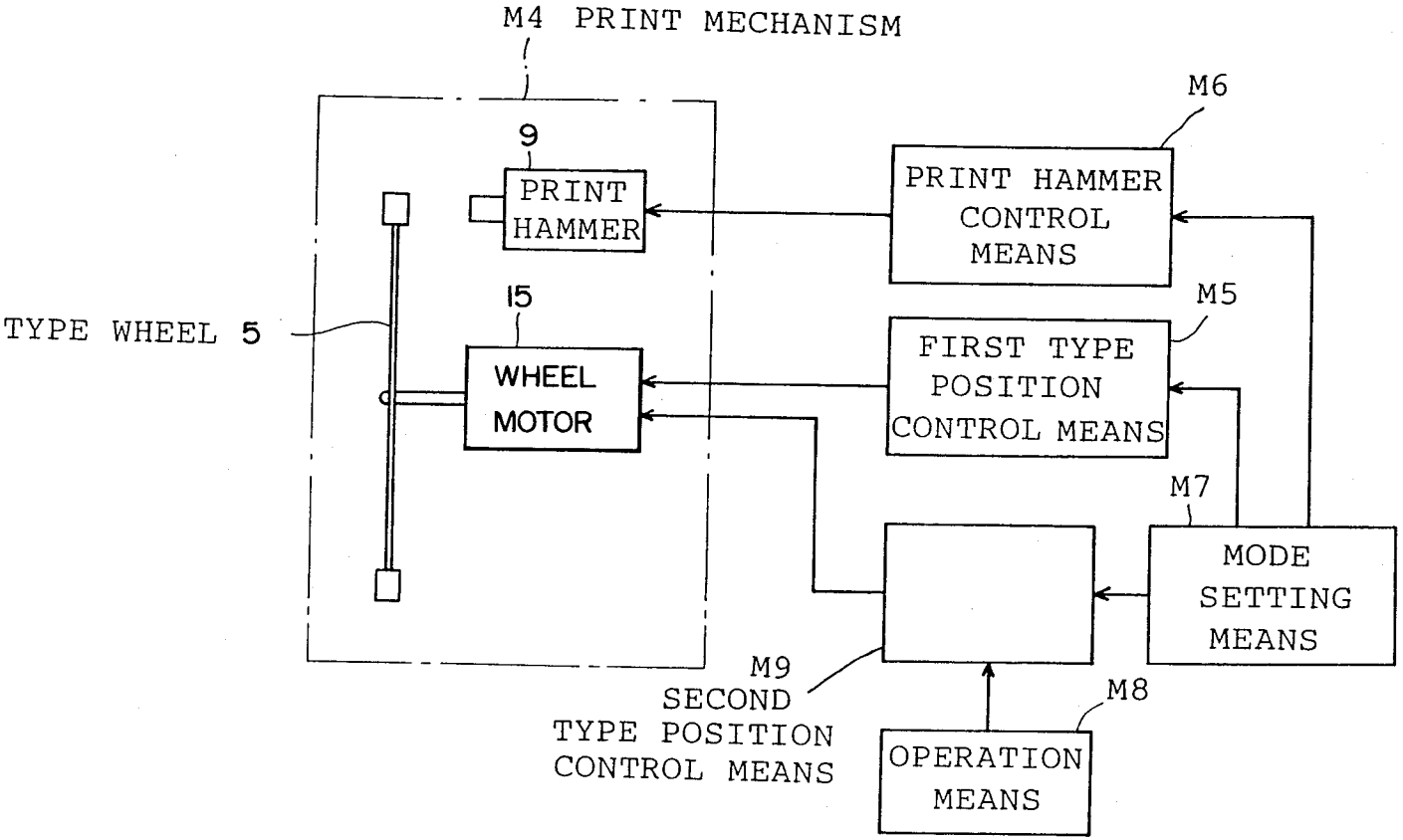
FIG. 1 is a schematic diagram for explaining an essential structure of a printer embodying the present invention.

The electronic control unit 1 as a logic and arithmetic circuit, mainly comprises a well-known CPU 31, a ROM 33 and a RAM 35. The electronic control unit 1 further comprises an input/output circuit 37, a motor drive circuit 39 and a solenoid drive circuit 41. The input/output circuit 37 inputs the print information from an external device, instruction signals from a switch panel 23, and detection signals from various sensors. These sensors (not shown) detect, for example, a stuck sheet of paper 13, a type of ink ribbon used for printing, and so on. Furthermore, the input/output circuit 37 outputs display signals to the switch panel 23. The motor drive circuit 39 controls the rotation of the wheel motor 15 of the carriage 3 and the paper feed motor 21. The solenoid drive circuit 41 controls a solenoid for driving the print hammer 9 and other solenoids provided in the printer. The electronic control unit 1 corresponds to the first type position control means M5, the print hammer control means M6, and the second type position control means M9 in FIG. 1.

Figure 4:
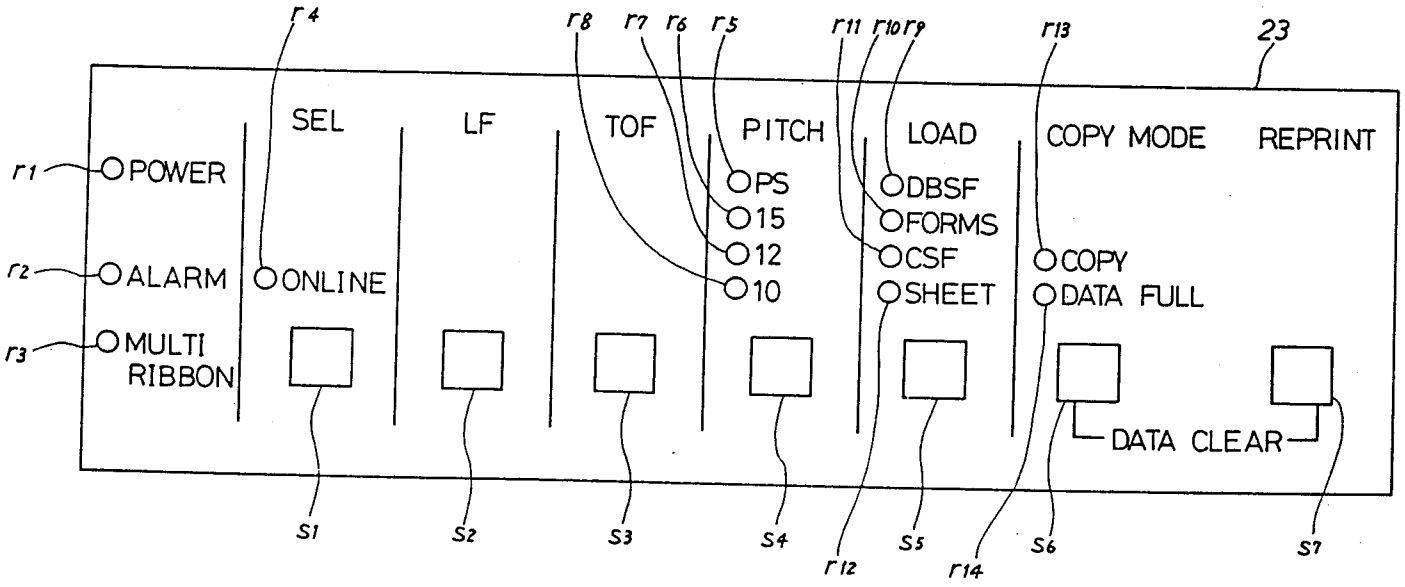
FIG. 4 is a plan view of a switch panel of the printer.

As shown in FIG. 4, the switch panel 23 is provided with various switches as operation means M8 of the printer and also provided with various lamps as an indicator section showing operating conditions of the printer. More specifically, the switch panel 23 comprises: a POWER lamp r1 for showing whether the printer is turned on or off; an ALARM lamp r2 for showing an error in paper setting, such as a stuck sheet of paper 13; a MULTI RIBBON lamp r3 for indicating a type of the ink ribbon 7; a SEL switch s1 for inputting the print information as well as for preventing input of the print information; an ONLINE lamp r4 for indicating the operation on the SEL switch s1; a LINE FEED (LF) switch s2 for feeding a sheet of paper 13; a TOP OF FORM (TOF) switch s3 for setting and discharging paper 13; a PITCH switch s4 for determining a space between printed characters on paper 13, namely, an interval in the movement of the carriage 3 along the axis of the platen 11; PITCH indicator lamps r5, r6, r7, and r8 for indicating the predetermined interval; a LOAD switch s5 for selecting a type of paper 13 used for printing; paper indicator lamps r9, r10, r11, and r12 for indicating the predetermined type of paper 13, a COPY MODE switch s6 for storing the print information from the external in a predetermined memory area; a COPY lamp r13 for showing that the print information is being stored; a DATA FULL lamp r14 for showing that the memory area is full of stored data; and a REPRINT switch s7 for commanding printing according to the stored print information.

The electronic control unit 1 controls the above-mentioned mechanical portions according to operation commands input through the switches on the switch panel 23 so as to execute printing. Simultaneously, the electronic control unit 1 indicates the operating state by the lamps on the switch panel 23. During this normal printing mode, the wheel motor 15 is activated strongly when it is rotated, activated weakly when it is stopped in a required position, and activated strongly when the print hammer 9 strikes the type 5*i* on the type wheel 5. The strong activation enables the type 5*i* set in at the printing position to be fixed securely and prevents the strike by the print hammer 9 from displacing the type 5*i* from the printing position.

When the printer in this embodiment is turned on by pressing a power switch, shown by a symbol "So" in FIG. 2, together with LF switch s2, TOF switch s3 and PITCH switch s4, the printing action executed by the electronic control unit 1 is prevented and the normal printing mode is switched into an adjustment mode for adjusting the attached position of the print hammer 9. In this adjustment mode, in which the electronic control unit 1 executes an adjustment of the print hammer's position, each of the switches s2–s7 on the switch panel 23 functions as an element of operation means for rotating the wheel motor 15 in a predetermined direction and setting a predetermined type in the printing position. In the adjustment mode, each of the PITCH indicator lamps r5–r8, the COPY lamp r13, and the DATA FULL lamp r14 functions as an element of an indicator section showing the process of the position-adjustment, as will be explained later. Thus, the LF switch s2, the TOF switch s3, the PITCH switch s4 and the POWER switch "So" correspond to the mode setting means M7 in FIG. 1, and the switches s2–s7 on the switch panel 23 correspond to the operation means M8. Referring to the main flowchart in FIG. 5C, when the printer is in the adjustment mode, the SEL switch s1 on switch panel 23 functions as an adjustment mode cancel switch and then a press on the SEL switch s1 changes the adjustment mode into the normal printing mode. In this embodiment, the adjustment mode is also changed into the printing mode when the adjustment mode has continued for a predetermined time period, e.g., ten minutes in this embodiment.

Figure 5A:
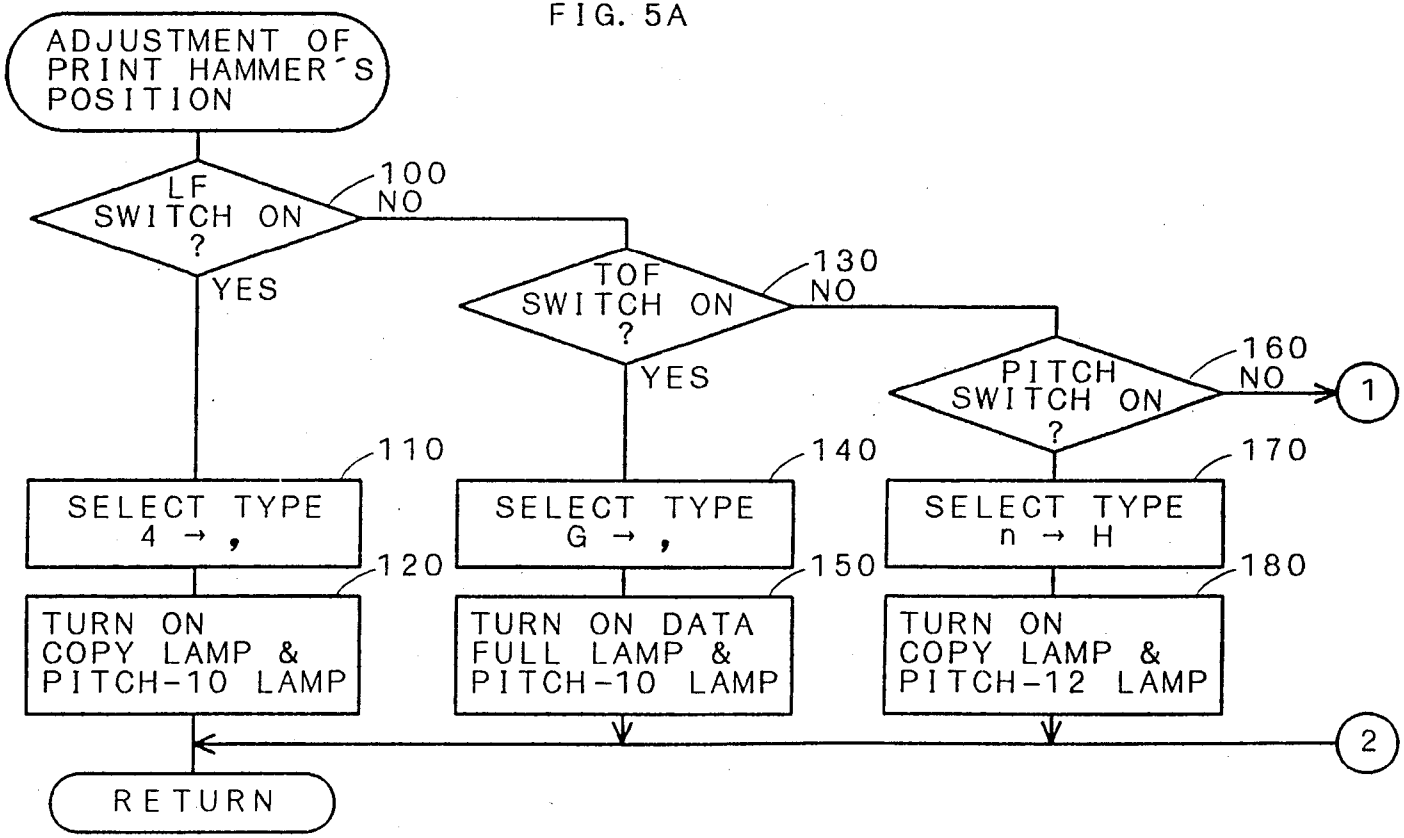
FIGS. 5A, 5B, and 5C are flowcharts for explaining a process of an adjustment of the print hammer's position executed by an electronic control unit.
Figure 5B:
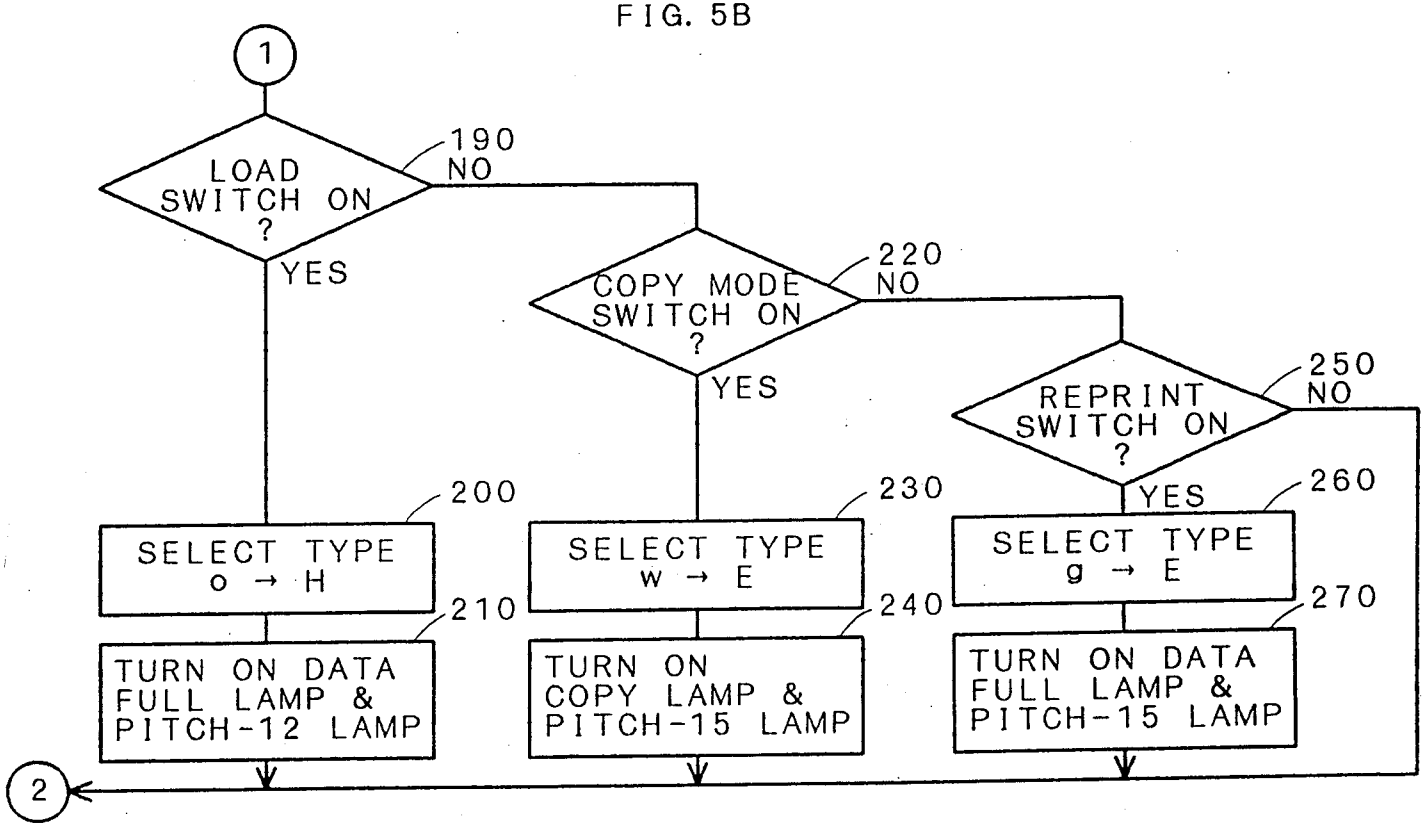
Figure 5C:
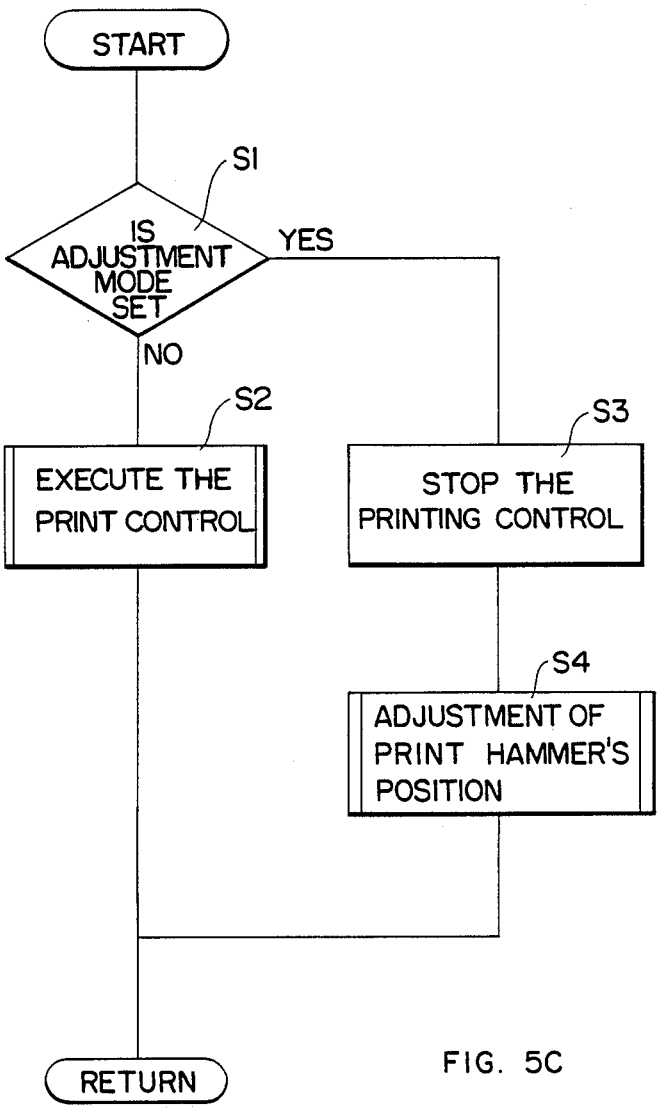

Now, according to FIGS. 5A and 5B, a detailed explanation will be given for a process of adjusting the print hammer position executed by the electronic control unit 1 in the adjustment mode. Numerals 100 through 270 denote the step numbers in the flowchart. The wheel motor 15 in the adjustment mode is constantly activated strongly.

First of all, STEP 100 determines if the LF switch s2 has been pressed or not. If the answer is YES, the program proceeds to STEP 110. At STEP 110, the wheel motor 15 rotates the type wheel 5 so as to select a type "4" on the type wheel 5 and set it into the printing position, and then the type wheel 5 is rotated to the left so as to select and set a type "," into the printing position. Thereafter, STEP 120 turns on the COPY lamp r13 for showing that the type wheel 5 has been rotated to the left and the PITCH-10 lamp r8 for showing that the type "," is set in the printing position. After STEP 120, the program returns to STEP 100.

If STEP 100 determines that the LF switch s2 has not been pressed, then STEP 130 determines if the TOF switch s3 has been pressed or not. If the answer is YES at STEP 130, the program proceeds to STEP 140, where the type wheel 5 is rotated so as to select a type "G" and then rotated to the right so as to select the type ",". Thereafter, STEP 150 turns on the DATA FULL lamp r14 for showing that the type wheel 5 has been rotated to the right and the PITCH-10 lamp r8 for showing that the type "," is selected to be set in the printing position. After STEP 150, the program returns to STEP 100.

Figure 6A:
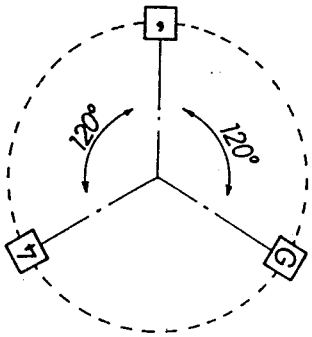
FIGS. 6A, 6B and 6C illustrate a type arrangement on the type wheel.

As shown in FIG. 6A which illustrates an arrangement of three types on the type wheel 5 in the present embodiment, the type "4" is located substantially 120° to the left of the type "," and the type "G" is located substantially 120° to the right of the type ",". Therefore, the type wheel 5 rotates to the left about 120° at STEP 110 so as to select the type ",", and rotates to the right about 120° at STEP 140 so as to select the type ",".

If STEP 130 determines that the TOF switch s3 has not been pressed, then STEP 160 determines if the PITCH switch s4 has been pressed or not. If the answer is YES, the program proceeds to STEP 170. At STEP 170, the type wheel 5 is rotated so as to select a type "n" and set it into the printing position, and then the type wheel 5 is rotated to the left so as to select and set a type "H" into the printing position. Thereafter, STEP 180 turns on the COPY lamp r13 for showing the type wheel's rotation to the left and the PITCH-12 lamp r7 for showing that the type "H" is set in the printing position. After STEP 180, the program returns to STEP 100.

If STEP 160 determines that the PITCH switch s4 has not been pressed, then, STEP 190 determines if the LOAD switch s6 has been pressed or not. If the answer is YES at STEP 190, the program proceeds to STEP 200, where the type wheel 5 is rotated so as to select a type "0", and is then rotated to the right so as to select the type "H". Thereafter, STEP 210 turns on the DATA FULL lamp r14 for showing the type wheel's rotation to the right and the PITCH-12 lamp r7 for showing that the type "H" is selected to be set in the printing position. After STEP 210, the program returns to STEP 100.

Figure 6B:
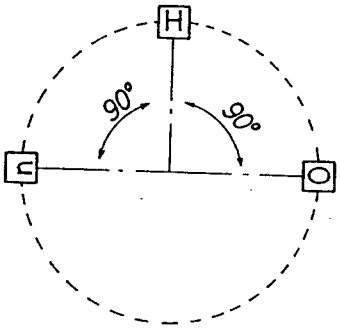

As shown in FIG. 6B which illustrates another arrangement of three types on the type wheel 5 in the present embodiment, the type "n" is located substantially 90° to the left of the type "H" and the type "0" is located substantially 90° to the right of the type "H". Therefore, the type wheel 5 rotates to the left about 90° at STEP 170 so as to select the type "H", and rotates to the right about 90° at STEP 200 so as to select the type "H".

If STEP 190 determines that the LOAD switch s5 has not been pressed, then, STEP 220 determines if the COPY MODE switch s6 has been pressed or not. If the answer is YES, the program proceeds to STEP 230. At STEP 230, the type wheel 5 is rotated so as to select a type "w" to set it into the printing position, and then the type wheel 5 is rotated to the left so as to select and set a type "E" into the printing position. Thereafter, STEP 240 turns on the COPY lamp r13 for showing the type wheel's rotation to the left and the PITCH-15 lamp r6 for showing that the type "E" is selected to be set in the printing position. After STEP 240, the program returns to STEP 100.

If STEP 220 determines that the COPY MODE switch s6 has not been pressed, then, STEP 250 determines if the REPRINT switch s7 has been pressed or not. It the REPRINT switch s7 has not been pressed, the program returns to STEP 100. On the other hand, if the answer is YES at STEP 250, the program proceeds to STEP 260, where the type wheel 5 is rotated so as to select a type "g" and then rotated to the right so as to select the type "E". Thereafter, STEP 270 turns on both the DATA FULL lamp r14 for showing the type wheel's rotation to the right and the PITCH-15 lamp r6 for showing that the type "E" is selected to be set in the printing position. After STEP 270, the program returns to STEP 100.

Figure 6C:
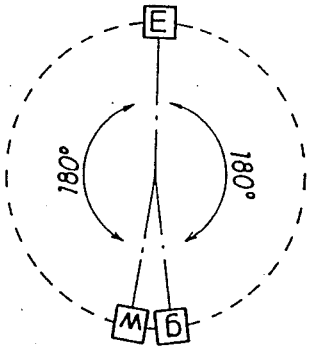

As shown in FIG. 6C illustrating a type arrangement of the type wheel 5 in the present embodiment, the types "w" and "g" are both located at an angle of substantially 180° to the type "E". Thus, the type wheel 5 rotates to the left about 180° at STEP 230 so as to select the type "E", and rotates to the right about 180° at STEP 260 so as to select the type "E".

When the printer in the present embodiment is turned on by operating the power switch So and the other switches s2–s7 on the switch panel 23 as explained above according to the flowchart, the printer will be in the adjustment mode where each switch on the switch panel 23 functions as means of adjusting the position of the print hammer 5. More particularly, the operation on the switch panel 23 in the adjustment mode selects the predetermined types to be set into the printing position and indicates these selecting conditions by means of the indicator lamps r5–r8, r13 and r14 on the switch panel 23.

According to the present embodiment, it is possible to change the normal printing mode into the adjustment mode by operating the switches on the switch panel 23 and to set a predetermined type into the printing position. Corresponding to this predetermined type 5*i*, the contact portion of the print hammer 9, that is, an end portion thereof is adjusted to be located opposite to the type 5*i*. In addition, the type selecting action in the adjustment mode is shown by the indicator lamps on the switch panel 23. Thus, the user can check the present operating condition of the printer during the adjustment, resulting in improved operating efficiency. Furthermore, the wheel motor 15 in the adjustment mode is activated strongly so that the types are set into the printing position in the same manner as in the printing mode. As a result, the adjustment of the position is accomplished with high accuracy.

In the present embodiment, the type wheel 5 selectively rotates 120 degrees, 90 degrees, and 180 degrees to the left and to the right so as to set one of the predetermined types into the printing position. To elaborate, the adjustment of the attaching position is carried out in the following manner: to adjust the position of the print hammer 9, the type "," is selected as a result of the type wheel's rotation through 120° both to the left and the right; and in order to ascertain the position adjusted through the selection of the type ",", the type "H" is selected as a result of the wheel's rotation through 90° both to the left and the right, and the type "E" is selected as a result of the wheel's rotation through 180° both to the left and the right. Therefore, the attached position of the print hammer 9 is adjusted with high accuracy corresponding to a variety of stop positions of the types, the variety depending on: the rotational direction of the type wheel 5; the accuracy in stopping the wheel motor 15; the weight of the spoke 5*b*; and so on.

In the present embodiment, the adjustment mode is automatically switched into the printing mode when the adjustment mode has continued for ten minutes, as mentioned above. This time period should be predetermined because the wheel motor 15 will be heated too much by a current which is great enough to strongly activate the wheel motor 15. In other words, the predetermined time period prevents the wheel motor 15 from being continuously strongly activated for too long, and accordingly prevents the burning of the wheel motor 15.

In this embodiment, the rotation of the wheel motor 15 is expressed by angle of rotation. More particularly, the stepping motor used in the embodiment makes one rotation by 192 steps and it selects a desired type among 96 types on the type wheel 5 according to the number of steps.

Obviously, many modifications and variations of the present invention are possible. It is therefore to be understood that within the scope of the appended claims the invention may be practiced other than as specifically described.

What is claimed is:

1. A printing control device comprising:

a print mechanism including a type wheel provided with a plurality of types, a wheel member for rotating the type wheel, and a print hammer secured adjustably to a relative position opposite the type wheel;

first type position control means for driving the wheel member so as to rotate the type wheel and to set a type of the type wheel into a printing position in response to print information during a printing mode;

print hammer control means for striking the type with the print hammer so as to print a character on a sheet corresponding to the print information during the printed mode;

mode setting means for preventing operation of both the first type position control means and the print hammer control means, and for setting an adjustment mode in which said relative position of the print hammer can be adjusted;

operation means for selecting a predetermined type on the type wheel; and second type position control means responsive to the mode setting means for driving the wheel motor so as to rotate the type wheel to set the predetermined type selected by the operation means into the relative position during the adjustment mode, said second type position control means comprising means for selecting a first predetermined type by rotating the type wheel at least one predetermined amount in a predetermined direction and means for selecting a second predetermined type by rotating the type wheel said at least one predetermined amount in an opposite direction relative to the predetermined direction; thereby allowing an operator to adjust the relative position between the print hammer and the predetermined type by adjusting an attachment position of the print hammer onto the wheel motor.

2. The printing control device according to claim 1, wherein the wheel motor comprises a stepping motor.

3. The printing control device according to claim 2, wherein the first type position control means includes means for strongly activating the stepping motor while it is rotated during the printing mode, and for weakly activating the stepping motor while the type wheel is controlled to be stopped in a determined position during the printing mode; and the second type position control means includes means for strongly activating the stepping motor all the time during the adjustment mode.

4. The printing control device according to claim 1, wherein the second type position control means includes display means for indicating the completion of selecting actions of various types.

5. The printing control device according to claim 1, further comprising a mode resuming means for automatically switching the adjustment mode into the printing mode when the adjustment mode has continued for a predetermined time period.

* * * * *